US011431434B2

(12) United States Patent
Ju

(10) Patent No.: US 11,431,434 B2
(45) Date of Patent: Aug. 30, 2022

(54) METHOD AND APPARATUS FOR SECURE COMMUNICATION IN WIRELESS COMMUNICATION SYSTEM

(71) Applicant: ELECTRONICS AND TELECOMMUNICATIONS RESEARCH INSTITUTE, Daejeon (KR)

(72) Inventor: Hyung Sik Ju, Hwaseong-si (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 21 days.

(21) Appl. No.: 16/952,470

(22) Filed: Nov. 19, 2020

(65) Prior Publication Data

US 2021/0175995 A1 Jun. 10, 2021

(30) Foreign Application Priority Data

Dec. 10, 2019 (KR) ..... 10-2019-0164092
Nov. 9, 2020 (KR) ..... 10-2020-0148889

(51) Int. Cl.
*H04K 3/00* (2006.01)

(52) U.S. Cl.
CPC ..... *H04K 3/42* (2013.01); *H04K 3/43* (2013.01); *H04K 3/44* (2013.01)

(58) Field of Classification Search
CPC .. H04K 3/42; H04K 3/44; H04K 3/43; H04K 3/40; H04K 3/00; H04K 3/224
See application file for complete search history.

(56) References Cited

U.S. PATENT DOCUMENTS

| | | | | |
|---|---|---|---|---|
| 7,430,257 | B1 * | 9/2008 | Shattil | H04B 1/707 375/349 |
| 9,391,745 | B2 * | 7/2016 | Agee | H04L 27/2602 |
| 9,686,038 | B2 | 6/2017 | Shapira | |
| 9,820,209 | B1 * | 11/2017 | Agee | H04W 72/0453 |
| 10,154,397 | B2 | 12/2018 | Agee | |
| 10,397,080 | B2 | 8/2019 | Brik et al. | |
| 10,673,758 | B2 * | 6/2020 | Shattil | H04L 47/10 |

(Continued)

FOREIGN PATENT DOCUMENTS

| | | | |
|---|---|---|---|
| KR | 10-1491778 | B1 | 2/2015 |
| KR | 2019/0069290 | A | 6/2019 |

*Primary Examiner* — Nhan T Le
(74) *Attorney, Agent, or Firm* — LRK Patent Law Firm

(57) ABSTRACT

A security signal transmission method performed by a first communication node includes estimating a radio channel between the first communication node and a second communication node; classifying all subcarriers into a first subcarrier group for transmitting a data signal and a second subcarrier group for transmitting a jamming signal based on estimated channel information; generating data symbol(s) by allocating the data signal to subcarriers of the first subcarrier group; generating jamming symbol(s) by allocating the jamming signal to subcarriers of the second subcarrier group; generating a first control symbol to which a first control signal is mapped, the first control signal including a first reference value used to restore the data symbols at the second communication node; and transmitting the data symbol(s), the jamming symbol(s), and the first control symbol to the second communication node.

14 Claims, 8 Drawing Sheets

(56) References Cited

U.S. PATENT DOCUMENTS

| | | | |
|---|---|---|---|
| 2013/0266142 | A1 | 10/2013 | Hwang et al. |
| 2015/0146872 | A1 | 5/2015 | Baek et al. |
| 2015/0188662 | A1 | 7/2015 | Shapira |
| 2018/0062841 | A1 | 3/2018 | Sahin et al. |
| 2019/0075091 | A1 | 3/2019 | Shattil et al. |
| 2019/0181974 | A1 | 6/2019 | Ju et al. |

* cited by examiner

FIG. 5

$\delta_{max} = 2\pi$
$\delta_{min} = 0$ } S510

$R_{max} = \frac{1}{N}\sum_{k=0}^{N-1} \log_2(1 + \eta|H(k)|^2)$ S520

$R = R_{max} - R_{req}$ S530 while $|\delta_{max} - \delta_{min} > d|$ S540

$\bar{\delta} = (\delta_{max} - \delta_{min})/2$ S550

$S_D = \{k | \theta_k < \bar{\delta}\}$ S560

$R = \frac{1}{N}\sum_{k \in S_D} \log_2(1 + \eta|H(k)|^2)$ S570 if $R \geq R_{req}$
$\delta_{min} = \bar{\delta}$
else
$\delta_{max} = \bar{\delta}$
end } S580
end $\delta = \max(|\theta_k * S_D - (\theta_{k'} * S_D)|)$ S590

FIG. 6

$\delta_{max} = 2\pi$
$\delta_{min} = 0$ } S610

$R_{max} = NMC$ S620

$R = R_{max} - R_{req}$ S630 while $|\delta_{max} - \delta_{min} > d|$ S640

$\bar{\delta} = (\delta_{max} - \delta_{min})/2$ S650

$S_D = \{k | \theta_k < \bar{\delta}\}$ S660

$R = n(S_D)MC$ S670 if $R \geq R_{req}$
$\delta_{min} = \bar{\delta}$
else
$\delta_{max} = \bar{\delta}$
end } S680
end $\delta = \max(|\theta_k * S_D - (\theta_{k'} * S_D)|)$ S690

FIG. 7

$\delta_{max} = 2\pi$
$\delta_{min} = 0$ } S710

S720

$R_{max} = \frac{1}{Nt}\sum_{m=0}^{L-1}\sum_{k=0}^{N-1}\log_2(1+\eta|H(k)|^2)$ $R = R_{max} - R_{req}$ S730 while $|\delta_{max} - \delta_{min} > d|$ S740

$\bar{\delta} = (\delta_{max} - \delta_{min})/2$ S750

$S_D = \{k|\bar{\theta}_{m,k} < \bar{\delta}\}$ S760

$R = \frac{1}{Nt}\sum_{m,k\in S_D} log_2(1+\eta|H(k)|^2)$ S770 if $R \geq R_{req}$
$\delta_{min} = \bar{\delta}$
else
$\delta_{max} = \bar{\delta}$
end } S780
end $\delta = max(|\theta_{m,k} * S_D - (\theta_{m',k'} * S_D)|)$ S790

FIG. 8

$\delta_{max} = 2\pi$
$\delta_{min} = 0$ } S810

$R_{max} = NLMC$ S820
$R = R_{max} - R_{req}$ S830 while $|\delta_{max} - \delta_{min} > d|$ S840

$\bar{\delta} = (\delta_{max} - \delta_{min})/2$ S850

$S_D = \{k | \hat{\theta}_{m,k} < \bar{\delta}\}$ S860

$R = n(S_D)MC$ S870 if $R \geq R_{req}$
$\delta_{min} = \bar{\delta}$
else
$\delta_{max} = \bar{\delta}$ } S880
end
end

S890

$\delta = max(|\theta_{m,k} * S_D - (\theta_{m',k'} * S_D)|)$

METHOD AND APPARATUS FOR SECURE COMMUNICATION IN WIRELESS COMMUNICATION SYSTEM

CROSS-REFERENCE TO RELATED APPLICATIONS

This application claims priority to Korean Patent Applications No. 10-2019-0164092 filed on Dec. 10, 2019 and No. 10-2020-0148889 filed on Nov. 9, 2020 with the Korean Intellectual Property Office (KIPO), the entire contents of which are hereby incorporated by reference.

BACKGROUND

1. Technical Field

The present disclosure relates to a method and an apparatus for secure communication in a wireless communication system, and more specifically, to a method and an apparatus for efficiently performing subcarrier allocation while achieving a physical layer security (PHYSEC) in a multi-subcarrier based wireless communication system.

2. Description of Related Art

With the development of information and communication technology, various wireless communication technologies have been developed. Typical wireless communication technologies include long term evolution (LTE) and new radio (NR), which are defined in the 3rd generation partnership project (3GPP) standards. The LTE may be one of 4th generation (4G) wireless communication technologies, and the NR may be one of 5th generation (5G) wireless communication technologies.

Meanwhile, due to characteristics of radio signals transmitted wirelessly in the air, there is a possibility that a wireless communication system is exposed to eavesdropping. Therefore, a technology for preventing the eavesdropping and improving security in the wireless communication system may be required. For example, a security technology of a security key pre-sharing scheme may be applied to the wireless communication system. In this case, a transmitting node and a receiving node may secure security by encrypting and decrypting signals based on security key information pre-shared with each other. However, such the security scheme has a problem in that security performance may be seriously deteriorated when the security key pre-shared between the transmitting and receiving nodes is leaked.

SUMMARY

In order to solve the above-identified problems, exemplary embodiments of the present disclosure are directed to providing a communication security method and apparatus for sharing subcarrier allocation information and achieving physical layer security in a multi-subcarrier based wireless communication system, by making transmitting and receiving nodes share one real value regardless of eavesdropping.

According to an exemplary embodiment of the present disclosure for achieving the above-described objective, a method for transmitting a security signal, performed by a first communication node in a communication system, may comprise estimating a radio channel between the first communication node and a second communication node; classifying all subcarriers constituting the radio channel into a first subcarrier group in charge of transmitting a data signal and a second subcarrier group in charge of transmitting a jamming signal, based on channel information of the estimated radio channel; generating at least one data symbol by allocating the data signal to subcarriers of the first subcarrier group; generating at least one jamming symbol by allocating the jamming signal to subcarriers of the second subcarrier group; generating a first control symbol to which a first control signal is mapped, the first control signal including a first reference value used to restore the at least one data symbol at the second communication node; and transmitting the at least one data symbol, the at least one jamming symbol, and the first control symbol to the second communication node.

The classifying of all subcarriers may comprise selecting a first reference subcarrier from among all the subcarriers based on the channel information; calculating a difference value between a phase of the first reference subcarrier and a phase of each of remaining subcarriers; and determining the first subcarrier group and the second subcarrier group based on the calculated difference value.

Subcarriers having a calculated difference value equal to or less than the first reference value may be determined as the first subcarrier group, and subcarriers having a calculated difference value greater than the first reference value may be determined as the second subcarrier group.

The selecting of the first reference subcarrier may comprise comparing signal magnitudes of all the subcarriers; and selecting a subcarrier having a largest signal magnitude among all the subcarriers as the first reference subcarrier.

The first reference value may be set based on a data rate required for communication between the first and second communication nodes.

According to an exemplary embodiment of the present disclosure for achieving the above-described objective, a method for receiving a security signal, performed by a first communication node in a communication system, may comprise estimating a radio channel between the first communication node and a second communication node; receiving a first control symbol from the second communication node; receiving a plurality of symbols from the second communication node through the radio channel; obtaining a first reference value from the first control symbol; classifying all subcarriers constituting the radio channel into a first subcarrier group in charge of transmitting a data signal and a second subcarrier group in charge of transmitting a jamming signal based on the first reference value and channel information of the radio channel; and obtaining the data signal by decoding symbols received through the first subcarrier group among the plurality of symbols.

The classifying of all subcarriers may comprise selecting a first reference subcarrier from among all the subcarriers based on the channel information; calculating a difference value between a phase of the first reference subcarrier and a phase of each of remaining subcarriers; and determining the first subcarrier group and the second subcarrier group based on the calculated difference value.

Subcarriers having a calculated difference value equal to or less than the first reference value may be determined as the first subcarrier group, and subcarriers having a calculated difference value greater than the first reference value may be determined as the second subcarrier group.

The selecting of the first reference subcarrier may comprise comparing signal magnitudes of all the subcarriers; and selecting a subcarrier having a largest signal magnitude among all the subcarriers as the first reference subcarrier.

According to an exemplary embodiment of the present disclosure for achieving the above-described objective, a first communication node in a communication system may comprise a processor; a memory electronically communicating with the processor;

and instructions stored in the memory, wherein when executed by the processor, the instructions may cause the first communication node to: estimate a radio channel between the first communication node and a second communication node; classify all resource elements constituting a resource block into a first resource element group in charge of transmitting a data signal and a second resource element group in charge of transmitting a jamming signal, based on channel information of the estimated radio channel, generate at least one data symbol by allocating the data signal to resource elements of the first resource element group; generate at least one jamming symbol by allocating the jamming signal to resource elements of the second subcarrier group; generate a first control symbol to which a first control signal is mapped, the first control signal including a first reference value used to restore the at least one data symbol at the second communication node; and transmit the at least one data symbol, the at least one jamming symbol, and the first control symbol to the second communication node.

The instructions may further cause the first communication node to: select a first reference resource element from among all the resource elements based on the channel information; calculate a difference value between a phase of the first reference resource element and a phase of each of remaining resource elements; and determine the first resource element group and the second resource element group based on the calculated difference value.

Resource elements having a calculated difference value equal to or less than the first reference value may be determined as the first resource element group, and resource elements having a calculated difference value greater than the first reference value may be determined as the second resource element group.

The instructions may further cause the first communication node to: compare signal magnitudes of all the resource elements constituting the resource block; and select a resource element having a largest signal magnitude among all the resource elements as the first reference resource element.

The instructions may further cause the first communication node to select the first reference resource element by selecting a first reference symbol among all symbols constituting the resource block and selecting a first reference subcarrier among all subcarriers constituting the first reference symbol.

According to the above-described exemplary embodiments of the present disclosure, a security design based on information on a radio channel between communication nodes may be applied to a wireless communication system. Even when information pre-shared by transmitting and receiving nodes is leaked or eavesdropped, security may be guaranteed. That is, the security of the wireless communication system may be secured without a separate security key pre-sharing procedure.

BRIEF DESCRIPTION OF DRAWINGS

FIG. 5 is a diagram for describing a first exemplary embodiment of a method for calculating a first reference value according to the present disclosure.

FIG. 6 is a diagram for describing a second exemplary embodiment of a method for calculating a first reference value according to the present disclosure.

FIG. 7 is a diagram for describing a third exemplary embodiment of a method for calculating a first reference value according to the present disclosure.

FIG. 8 is a diagram for describing a fourth exemplary embodiment of a method for calculating a first reference value according to the present disclosure.

DETAILED DESCRIPTION OF THE EMBODIMENTS

Figure 1:
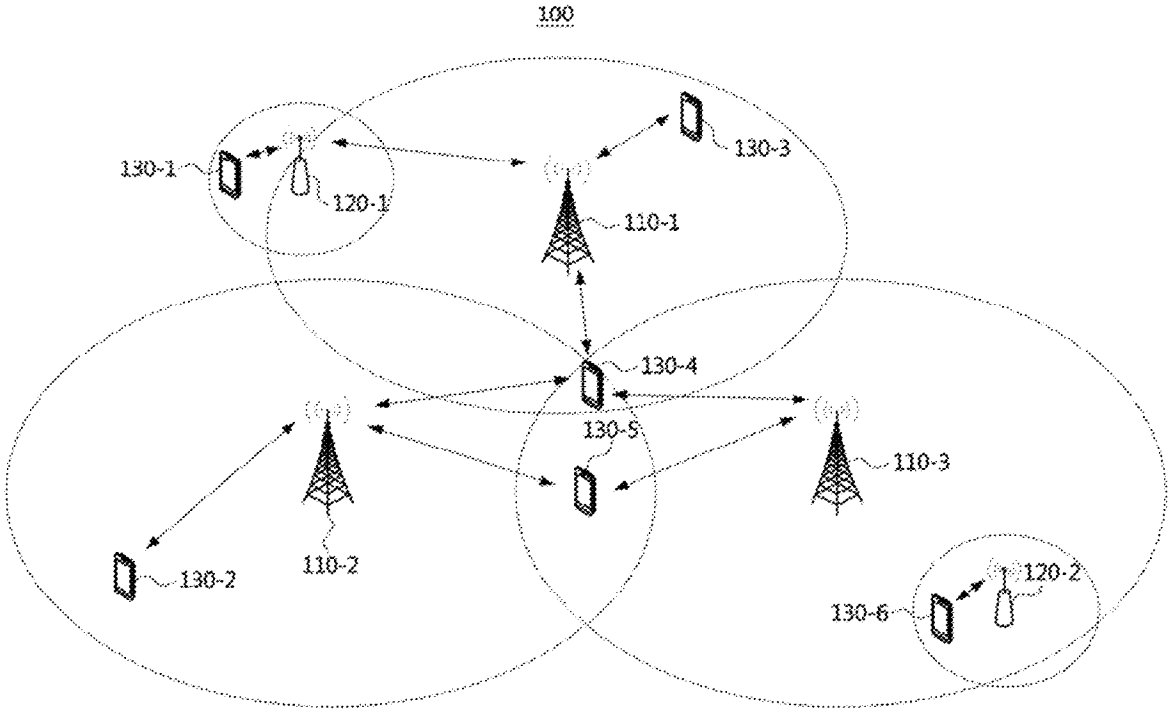
FIG. 1 is a conceptual diagram illustrating a first exemplary embodiment of a communication system.

Embodiments of the present disclosure are disclosed herein. However, specific structural and functional details disclosed herein are merely representative for purposes of describing embodiments of the present disclosure. Thus, embodiments of the present disclosure may be embodied in many alternate forms and should not be construed as limited to embodiments of the present disclosure set forth herein.

Accordingly, while the present disclosure is capable of various modifications and alternative forms, specific embodiments thereof are shown by way of example in the drawings and will herein be described in detail. It should be understood, however, that there is no intent to limit the present disclosure to the particular forms disclosed, but on the contrary, the present disclosure is to cover all modifications, equivalents, and alternatives falling within the spirit and scope of the present disclosure. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," etc.).

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. It will be further understood that the terms "comprises," "comprising," "includes" and/or "including,"

when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A communication system to which exemplary embodiments according to the present disclosure are applied will be described. The communication system to which the exemplary embodiments according to the present disclosure are applied is not limited to the contents described below, and the exemplary embodiments according to the present disclosure may be applied to various communication systems. Here, the communication system may have the same meaning as a communication network.

Throughout the present specification, a network may include, for example, a wireless Internet such as wireless fidelity (WiFi), mobile Internet such as a wireless broadband Internet (WiBro) or a world interoperability for microwave access (WiMax), 2G mobile communication network such as a global system for mobile communication (GSM) or a code division multiple access (CDMA), 3G mobile communication network such as a wideband code division multiple access (WCDMA) or a CDMA2000, 3.5G mobile communication network such as a high speed downlink packet access (HSDPA) or a high speed uplink packet access (HSUPA), 4G mobile communication network such as a long term evolution (LTE) network or an LTE-Advanced network, 5G mobile communication network, or the like.

Throughout the present specification, a terminal may refer to a mobile station, mobile terminal, subscriber station, portable subscriber station, user equipment, an access terminal, or the like, and may include all or a part of functions such as the terminal, mobile station, mobile terminal, subscriber station, mobile subscriber station, user equipment, access terminal, or the like.

Here, a desktop computer, laptop computer, tablet PC, wireless phone, mobile phone, smart phone, smart watch, smart glass, e-book reader, portable multimedia player (PMP), portable game console, navigation device, digital camera, digital multimedia broadcasting (DMB) player, digital audio recorder, digital audio player, digital picture recorder, digital picture player, digital video recorder, digital video player, or the like having communication capability may be used as the terminal.

Throughout the present specification, the base station may refer to an access point, radio access station, node B, evolved node B (eNodeB), base transceiver station, mobile multihop relay (MMR)-BS, or the like, and may include all or part of functions such as the base station, access point, radio access station, nodeB, eNodeB, base transceiver station, and MMR-BS.

Hereinafter, preferred exemplary embodiments of the present disclosure will be described in more detail with reference to the accompanying drawings. In describing the present disclosure, in order to facilitate an overall understanding, the same reference numerals are used for the same elements in the drawings, and duplicate descriptions for the same elements are omitted.

FIG. 1 is a conceptual diagram illustrating a first exemplary embodiment of a communication system.

Referring to FIG. 1, a communication system 100 may be a communication system based on a cellular communication scheme. The communication system 100 may comprise a plurality of communication nodes 110-1, 110-2, 110-3, 120-1, 120-2, 130-1, 130-2, 130-3, 130-4, 130-5, and 130-6. In addition, the communication system 100 may further include a core network. When the communication system 100 supports 4G communication, the core network may include a serving-gateway (S-GW), packet data network (PDN)-gateway (P-GW), mobility management entity (MME), and the like. When the communication system 100 supports 5G communication system, the core network may include a user plane function (UPF), a session management function (SMF), an access and mobility management function (AMF), and the like.

The plurality of communication nodes may support 4G communication (e.g., long term evolution (LTE), LTE-Advanced (LTE-A)), 5G communication (e.g., new radio (NR)), or the like specified in the 3rd generation partnership project (3GPP) specifications. The 4G communication may be performed in a frequency band of 6 GHz or below, and the 5G communication may be performed in a frequency band of 6 GHz or above as well as the frequency band of 6 GHz or below. For example, for the 4G and 5G communications, the plurality of communication nodes may support a code division multiple access (CDMA) based communication protocol, a wideband CDMA (WCDMA) based communication protocol, a time division multiple access (TDMA) based communication protocol, a frequency division multiple access (FDMA) based communication protocol, an orthogonal frequency division multiplexing (OFDM) based communication protocol, a filtered OFDM based communication protocol, a cyclic prefix OFDM (CP-OFDM) based communication protocol, a discrete Fourier transform spread OFDM (DFT-s-OFDM) based communication protocol, an orthogonal frequency division multiple access (OFDMA) based communication protocol, a single carrier FDMA (SC-FDMA) based communication protocol, a non-orthogonal multiple access (NOMA) based communication protocol, a generalized frequency division multiplexing (GFDM) based communication protocol, a filter bank multi-carrier (FBMC) based communication protocol, a universal filtered multi-carrier (UFMC) based communication protocol, a space division multiple access (SDMA) based communication protocol, or the like.

The communication system 100 may comprise a plurality of base stations 110-1, 110-2, 110-3, 120-1, and 120-2, and a plurality of terminals 130-1, 130-2, 130-3, 130-4, 130-5, and 130-6. The communication system 100 including the base stations 110-1, 110-2, 110-3, 120-1, and 120-2 and the terminals 130-1, 130-2, 130-3, 130-4, 130-5, and 130-6 may be referred to as an 'access network'. Each of the first base station 110-1, the second base station 110-2, and the third base station 110-3 may form a macro cell, and each of the fourth base station 120-1 and the fifth base station 120-2 may form a small cell. The fourth base station 120-1, the third terminal 130-3, and the fourth terminal 130-4 may belong to cell coverage of the first base station 110-1. Also, the second terminal 130-2, the fourth terminal 130-4, and the fifth terminal 130-5 may belong to cell coverage of the second base station 110-2. Also, the fifth base station 120-2, the fourth terminal 130-4, the fifth terminal 130-5, and the sixth terminal 130-6 may belong to cell coverage of the third base station 110-3. Also, the first terminal 130-1 may belong to cell coverage of the fourth base station 120-1, and the sixth terminal 130-6 may belong to cell coverage of the fifth base station 120-2.

Here, each of the plurality of base stations 110-1, 110-2, 110-3, 120-1, and 120-2 may refer to a NodeB, evolved NodeB, gNB, ng-eNB, base transceiver station (BTS), radio base station, radio transceiver, access point, access node, road side unit (RSU), radio remote head (RRH), transmission point (TP), transmission and reception point (TRP), flexible (f)-TRP, or the like. Each of the plurality of terminals 130-1, 130-2, 130-3, 130-4, 130-5, and 130-6 may refer to a user equipment (UE), terminal, access terminal, mobile terminal, station, subscriber station, mobile station, portable subscriber station, node, device, device supporting Internet of things (IoT) functions, mounted module/device/terminal, on board unit (OBU), or the like.

Meanwhile, each of the plurality of base stations 110-1, 110-2, 110-3, 120-1, and 120-2 may operate in the same frequency band or in different frequency bands. The plurality of base stations 110-1, 110-2, 110-3, 120-1, and 120-2 may be connected to each other via an ideal backhaul or a non-ideal backhaul, and exchange information with each other via the ideal or non-ideal backhaul. Also, each of the plurality of base stations 110-1, 110-2, 110-3, 120-1, and 120-2 may be connected to the core network through the ideal or non-ideal backhaul. Each of the plurality of base stations 110-1, 110-2, 110-3, 120-1, and 120-2 may transmit a signal received from the core network to the corresponding terminal 130-1, 130-2, 130-3, 130-4, 130-5, or 130-6, and transmit a signal received from the corresponding terminal 130-1, 130-2, 130-3, 130-4, 130-5, or 130-6 to the core network.

Also, each of the plurality of base stations 110-1, 110-2, 110-3, 120-1, and 120-2 may support multi-input multi-output (MIMO) transmission (e.g., a single-user MIMO (SU-MIMO), multi-user MIMO (MU-MIMO), massive MIMO, or the like), coordinated multipoint (CoMP) transmission, carrier aggregation (CA) transmission, transmission in an unlicensed band, device-to-device (D2D) communications (or, proximity services (ProSe)), or the like. Here, each of the plurality of terminals 130-1, 130-2, 130-3, 130-4, 130-5, and 130-6 may perform operations corresponding to the operations of the plurality of base stations 110-1, 110-2, 110-3, 120-1, and 120-2, and operations supported by the plurality of base stations 110-1, 110-2, 110-3, 120-1, and 120-2. For example, the second base station 110-2 may transmit a signal to the fourth terminal 130-4 in the SU-MIMO manner, and the fourth terminal 130-4 may receive the signal from the second base station 110-2 in the SU-MIMO manner. Alternatively, the second base station 110-2 may transmit a signal to the fourth terminal 130-4 and fifth terminal 130-5 in the MU-MIMO manner, and the fourth terminal 130-4 and fifth terminal 130-5 may receive the signal from the second base station 110-2 in the MU-MIMO manner.

The first base station 110-1, the second base station 110-2, and the third base station 110-3 may transmit a signal to the fourth terminal 130-4 in the CoMP transmission manner, and the fourth terminal 130-4 may receive the signal from the first base station 110-1, the second base station 110-2, and the third base station 110-3 in the CoMP manner. Also, each of the plurality of base stations 110-1, 110-2, 110-3, 120-1, and 120-2 may exchange signals with the corresponding terminals 130-1, 130-2, 130-3, 130-4, 130-5, or 130-6 which belongs to its cell coverage in the CA manner. Each of the base stations 110-1, 110-2, and 110-3 may control D2D communications between the fourth terminal 130-4 and the fifth terminal 130-5, and thus the fourth terminal 130-4 and the fifth terminal 130-5 may perform the D2D communications under control of the second base station 110-2 and the third base station 110-3.

Meanwhile, in a communication system, a base station may perform all functions (e.g., remote wireless transmission and reception function, baseband processing function, etc.) of a communication protocol. Alternatively, among all the functions of the communication protocol, the remote wireless transmission and reception function may be performed by a transmission reception point (TRP) (e.g., flexible (f)-TRP), and the baseband processing function may be performed by a baseband unit (BBU) block. The TRP may be a remote radio head (RRH), a radio unit (RU), a transmission point (TP), or the like. The BBU block may include at least one BBU or at least one digital unit (DU). The BBU block may be referred to as a 'BBU pool', 'centralized BBU', or the like. The TRP may be connected to the BBU block through a wired fronthaul link or a wireless fronthaul link. A communication system composed of backhaul links and fronthaul links may be as follows. When a function-splitting scheme of the communication protocol is applied, the TRP may selectively perform some functions of the BBU or medium access control (MAC) and radio link control (RLC) layers.

In the communication system 100, the base stations 110-1, 110-2, 110-3, 120-1, and 120-2 and the terminals 130-1, 130-2, 130-3, 130-4, 130-5, and 130-6 may perform communication in a licensed frequency band. On the other hand, in the communication system 100, the base stations 110-1, 110-2, 110-3, 120-1, and 120-2 and the terminals 130-1, 130-2, 130-3, 130-4, 130-5, and 130-6 may perform communication in an unlicensed frequency band.

Figure 2:
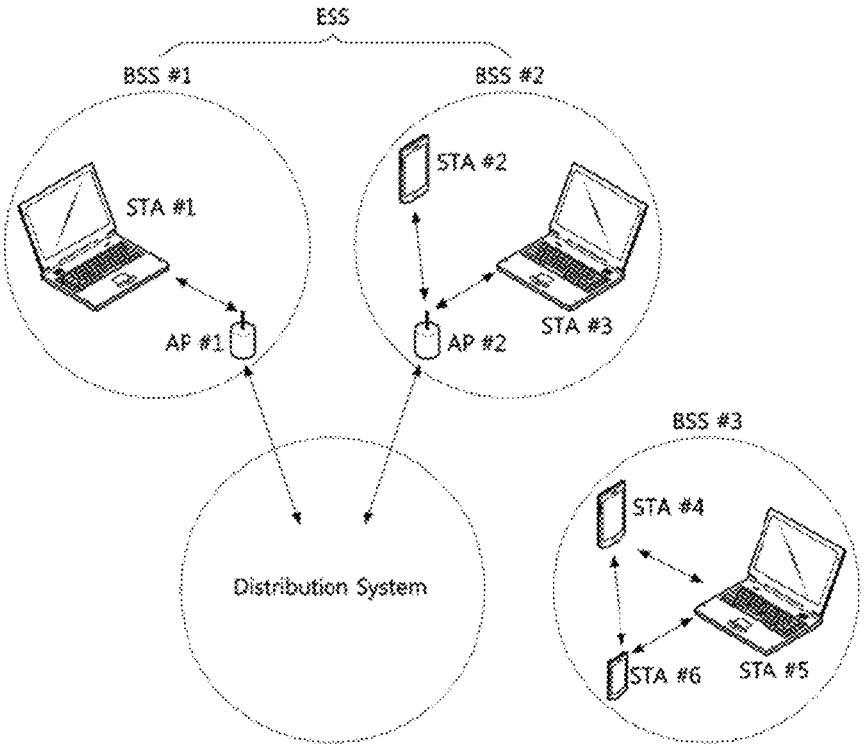
FIG. 2 is a conceptual diagram illustrating a second exemplary embodiment of a communication system.

FIG. 2 is a conceptual diagram illustrating a second exemplary embodiment of a communication system.

Referring to FIG. 2, a communication system may be a communication system according to the Institute of Electrical and Electronics Engineers (IEEE) 802.11 specifications (e.g., wireless local area network (WLAN) based communication system). The wireless LAN communication system may be referred to as a WLAN communication system or a Wireless Fidelity (Wi-Fi) communication system. In the WLAN communication system, a station (STA) may indicate a communication node performing a medium access control (MAC) layer function and a physical layer function for a wireless medium, which are specified in the IEEE 802.11 specifications. The STAs may be classified into an access point (AP) STA and a non-AP STA. The AP STA may be simply referred to as an access point, and the non-AP STA may simply be referred to as a station. In addition, the access point may be referred to as a base station (BS), node B, evolve node B, relay, RRH, TRP, or the like. The station may be referred to as a terminal, WTRU, UE, device, or the like, and may be a smart phone, tablet PC, laptop computer, sensor device, or the like.

The WLAN system may include at least one basic service set (BSS). The BSS denotes a set of STAs (e.g., STA1, STA2 (i.e., AP1), STA3, STA4, and STA5 (i.e., AP2), STA6, STA7, and STA8) capable of communicating with each other through successful synchronization, and is not a concept that denotes a specific area. In exemplary embodiments below, a station that performs a function of an access point may be referred to as an 'access point (AP)', and a station that does not perform the function of an access point may be referred to as a 'non-AP station' or simply 'station'.

The BSSs may be classified as infrastructure BSSs and independent BSSs (IBSSs). Here, a BSS1 and a BSS2 may be infrastructure BSSs, and a BSS3 may be an IBSS. The BSS1 may include the station STA1, the access point STA2 (i.e., AP1) that provides a distribution service, and a distribution system (DS) that connects the plurality of access points STA2 (i.e., AP1) and STA5 (i.e., AP2). In the BSS1, the access point STA2 (i.e., AP1) may manage the STA1.

The BSS2 may include the STA3 and the STA4, the access point STA5 (i.e., AP2) that provides the distribution service, and the distribution system that connects the plurality of access points STA2 (i.e., AP1) and STA5 (i.e., AP 2). In the BSS2, the access point STA5 (i.e., AP2) may manage the STA3 and the STA4.

The BSS3 may be an IBSS operating in an ad-hoc mode. In the BSS3, there is no AP which is an entity that performs a management function at a center. In other words, in the BSS3, the stations STA6, STA7, and STA8 may be managed in a distributed manner. In the BSS3, all the stations STA6, STA7, and STA8 may be mobile stations and may be not allowed to connect to the DS, thus constituting a self-contained network.

The access points STA2 (i.e., AP1) and STA5 (i.e., AP2) may provide access to the DS through a wireless medium for the stations STA1, STA3, and STA4 connected thereto. Communications between the stations STA1, STA3, and STA4 in the BSS 1 or the BSS2 are generally performed through the access points STA2 (i.e., AP1) and STA5 (i.e., AP2), but when a direct link is established, direct communications between the stations STA1, STA3, and STA4 are also possible.

A plurality of infrastructure BSSs may be interconnected via a DS. A plurality of BSSs connected through a DS is referred to as an extended service set (ESS). The stations (e.g., STA1, STA2 (i.e., AP1), STA3, STA4, and STA5 (i.e., AP2)) included in an ESS may communicate with each other, and a station (e.g., STA1, STA3, or STA4) in the ESS may move from one BSS to another BSS while performing seamless communication.

The DS is a mechanism for an AP to communicate with another AP, in which the AP may transmit a frame for stations connected to a BSS managed by the AP or may transmit a frame for an arbitrary station having moved to another BSS. Also, the AP may exchange frames with an external network, such as a wired network. Such the DS is not necessarily a network, and has any form capable of providing a predetermined distribution service defined in an IEEE 802.11 standard. For example, a DS may be a wireless network, such as a mesh network, or a physical structure that connects APs with each other.

Figure 3:
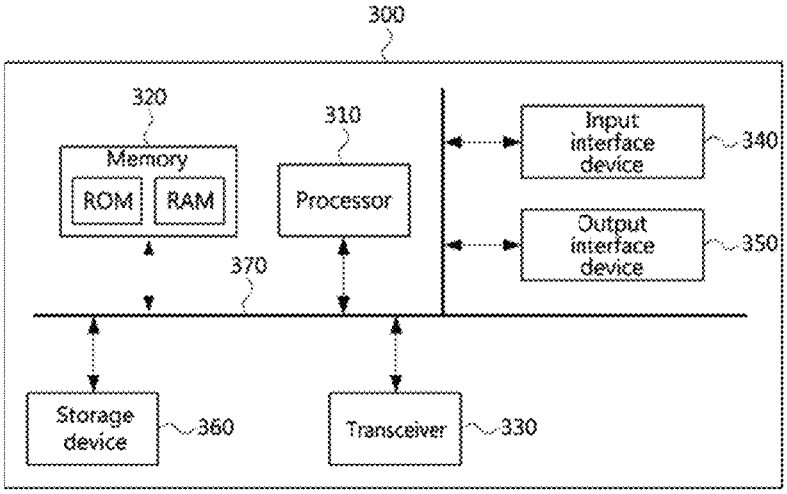
FIG. 3 is a block diagram illustrating an exemplary embodiment of a communication node constituting a communication system.

FIG. 3 is a block diagram illustrating an exemplary embodiment of a communication node constituting a communication system.

Referring to FIG. 3, a communication node 300 may be the communication node constituting the cellular communication system described with reference to FIG. 1 or the wireless LAN communication system described with reference to FIG. 2. Alternatively, the communication node 300 may be a communication node constituting various communication systems.

The communication node 300 may comprise at least one processor 310, a memory 320, and a transceiver 330 connected to the network for performing communications. Also, the communication node 300 may further comprise an input interface device 340, an output interface device 350, a storage device 360, and the like. Each component included in the communication node 300 may communicate with each other as connected through a bus 370. However, each component included in the communication node 300 may be connected to the processor 310 via an individual interface or a separate bus, rather than the common bus 370. For example, the processor 310 may be connected to at least one of the memory 320, the transceiver 330, the input interface device 340, the output interface device 350, and the storage device 360 via a dedicated interface.

The processor 310 may execute a program stored in at least one of the memory 320 and the storage device 360. The processor 310 may refer to a central processing unit (CPU), a graphics processing unit (GPU), or a dedicated processor on which methods in accordance with embodiments of the present disclosure are performed. Each of the memory 320 and the storage device 360 may be constituted by at least one of a volatile storage medium and a non-volatile storage medium. For example, the memory 320 may comprise at least one of read-only memory (ROM) and random access memory (RAM).

Meanwhile, due to characteristics of radio signals transmitted wirelessly in the air, there is a possibility that the wireless communication system is exposed to eavesdropping. For example, there may be an eavesdropper node in a communication environment, and the eavesdropper may attempt to eavesdrop a radio signal transmitted from a transmitting node to a receiving node. Therefore, a technology for preventing the eavesdropping and improving security in the wireless communication system may be required. For example, a security technology of a security key pre-sharing scheme may be applied to the wireless communication system. In this case, the transmitting node and the receiving node may encrypt and decrypt signals based on security key information pre-shared with each other. Since the eavesdropper node does not know the pre-shared security key, it is expected that it cannot properly decrypt the encrypted transmitted radio signal. However, such the security scheme has a problem in that security performance may be seriously deteriorated when the security key pre-shared between the transmitting node and the receiving node is leaked. That is, when the eavesdropper node acquires information of the shared security key in advance, there is a risk that the encrypted and transmitted radio signal is decrypted and eavesdropped by the eavesdropper node.

In order to solve this problem, a technology for securing security without prior sharing of a security key between a transmitting node and a receiving node may be required. The physical layer security (PHYSEC) scheme may be one of communication security technologies for securing security without a transmitting node and a receiving node sharing a security key in advance. According to the physical layer security scheme, it is possible to secure security between transmitting and receiving nodes by using characteristics of a physical layer radio channel instead of a security key, and to block the possibility of eavesdropping by an eavesdropper node. Accordingly, there is an advantage that the problem of security performance degradation due to leakage of the security key can be solved. In the physical layer security scheme, a specific operation of securing security between transmitting/receiving nodes based on radio channel information may be implemented variously according to exemplary embodiments.

In the conventional physical layer security scheme, there is a disadvantage in that an optimal design is possible only when a transmitting node knows not only channel information with an intended receiving node but also channel information between the transmitting node and an eavesdropper node. Alternatively, when the transmitting node does not know the radio channel between the transmitting node and the eavesdropper node, artificial noises or jamming signals may be transmitted by using a plurality of antennas in a null space of the channel between the transmitting node and the receiving node, thereby maintaining the security. However, in this case, there is a problem that a plurality of antennas should be used to maintain the security. Further, the physical layer security scheme has a problem in that it is not easy to maintain security when the number of antennas of the eavesdropper node exceeds the number of antennas of the transmitting node. Further, the physical layer security scheme has a problem in that the maintenance of security in a two-way communication environment is limited depending on the number of antennas of the receiving node.

Hereinafter, physical layer security schemes according to the present disclosure for solving the above-described problems will be described with reference to FIGS. 4 to 9.

Figure 4:
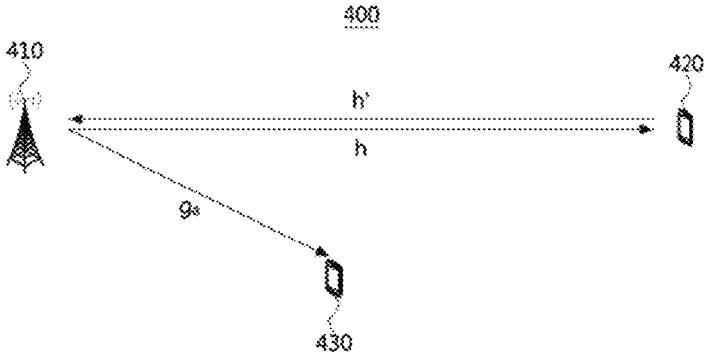
FIG. 4 is a conceptual diagram for describing first and second exemplary embodiments of a secure communication system according to the present disclosure.

FIG. 4 is a conceptual diagram for describing first and second exemplary embodiments of a secure communication system according to the present disclosure.

Hereinafter, a first exemplary embodiment of a secure communication system according to the present disclosure will be described with reference to FIG. 4. A secure communication system 400 may be the same as or similar to the cellular communication system described with reference to FIG. 1. Alternatively, the secure communication system 400 may be the same as or similar to the wireless LAN communication system described with reference to FIG. 2. Hereinafter, a configuration of the present disclosure will be described by taking a case where the secure communication system 400 is a communication system based on the cellular communication scheme. However, this is only an example for convenience of description, and the configuration of the present disclosure may be applied identically or similarly to a communication system based on not only the wireless LAN communication scheme or but also other wireless communication schemes.

Referring to FIG. 4, the secure communication system 400 may be a communication system to which a physical layer security scheme is applied. The secure communication system 400 may include a base station (BS) 410 and a terminal (e.g., mobile station (MS)) 420. The base station 410 and the terminal 420 may transmit and receive signals with each other through a radio channel. A radio channel from the base station 410 to the terminal 420 may be referred to as h. Also, a radio channel from the terminal 420 to the base station 410 may be referred to as h'. Each of the radio channels h and h' may be a multipath fading channel. Each of the radio channels h and h' may be a multipath fading channel having a frequency selectivity of a predetermined level or higher. The base station 410 and the terminal 420 may transmit signals based on a multi-subcarrier transmission scheme. For example, the base station 410 and the terminal 420 may transmit signals based on an OFDM communication scheme. The base station 410 and the terminal 420 may transmit and receive radio signals with each other in a time division duplex (TDD) scheme. Alternatively, the base station 410 and the terminal 420 may transmit and receive radio signals to and from each other in an in-band full duplex (IFD) scheme. In this case, channel reciprocity may be established between the radio channels h and h'. That is, the radio channels h and h' may be considered to be identical to each other. The base station 410 and the terminal 420 may identify information on the radio channel formed therebetween.

Meanwhile, an eavesdropper node 430 may exist in the communication environment. The eavesdropper node 430 may refer to a communication node for receiving and eavesdropping a signal transmitted from the base station 410. The eavesdropper node 430 may receive the signal transmitted from the base station 410 through a radio channel. The radio channel through which the eavesdropper node 430 receives the signal from the base station 410 may be referred to as $g_a$. The radio channel $g_a$ may be a multipath fading channel. The radio channel $g_a$ may be a multipath fading channel having a frequency selectivity of a predetermined level or higher.

In the secure communication system 400, the base station 410, the terminal 420, and the eavesdropper node 430 may be spaced apart from each other by a first configuration distance or more. In this case, the radio channels h and $g_a$ may be formed independently of each other.

The secure communication system 400 may secure security between the base station 410 and the terminal 420 based on information of the radio channel h from the base station 410 to the terminal 420 and information of the radio channel $g_a$ through which the eavesdropper node 430 receives the signal from the base station 410. The radio channel h may be expressed as H of Equation 1 in the frequency domain.

$$H=[H(0),H(1), \ldots ,H(N-1)] \quad \text{[Equation 1]}$$

In Equation 1, N may mean the number of subcarriers constituting the radio channel h. H(k) may mean the k-th subcarrier of the radio channel h from the base station 410 to the terminal 420. H(k) may be expressed as in Equation 2.

$$H(k)=|H(k)|e^{\theta_k},k=0,1, \ldots ,N-1 \quad \text{[Equation 2]}$$

In Equation 2, $\theta_k$ may mean a phase of H(k).

Meanwhile, the radio channel $g_A$ may be expressed as $G_a$ of Equation 3 in the frequency domain.

$$G_a=[G_a(0),G_a(1), \ldots ,G_a(N-1)] \quad \text{[Equation 3]}$$

In Equation 3, N may mean the number of subcarriers constituting the radio channel $g_a$. $G_a(k)$ may refer to the k-th subcarrier of the radio channel $g_a$ through which the eavesdropper node 430 receives the signal from the base station 410. $G_a(k)$ may be expressed as in Equation 4.

$$G_a(k)=|G_a(k)|e^{j\phi_k} \quad \text{[Equation 4]}$$

In Equation 4, $\phi_k$ may mean a phase of $G_a(k)$.

The base station 410 may select any one of the N subcarriers and configure it as a first reference subcarrier. A number of the first reference subcarrier selected as described above may be referred to as k*. Only the base station 410 has information on the first reference subcarrier, and the information may not be transferred to the terminal 420. The base station 410 may determine two subcarrier sets based on the first reference subcarrier k*. The base station 410 may determine a first subcarrier set $S_D$ and a second subcarrier set $S_J$ based on the first reference subcarrier k*. The first subcarrier set $S_D$ and the second subcarrier set $S_J$ may be expressed as Equations 5 and 6, respectively.

$$S_D=\{|\theta_k-\theta_{k*}|\leq\delta\} \quad \text{[Equation 5]}$$

$$S_J=\{k||\theta_k-\theta_{k*}|>\delta\} \quad \text{[Equation 6]}$$

Referring to Equations 5 and 6, the first subcarrier set $S_D$ and the second subcarrier set $S_J$ may be defined based on the first reference subcarrier k* and a first reference value δ. The first subcarrier set $S_D$ may be defined as a set of subcarriers in which a difference $|\theta_k-\theta_{k*}|$ between a phase of each subcarrier and a phase of the first reference subcarrier is less than or equal to the first reference value δ. On the other hand, the second subcarrier set $S_J$ may be defined as a set of subcarriers in which the difference $|\theta_k-\theta_{k*}|$ between the phase of each subcarrier and the phase of the first reference subcarrier is greater than the first reference value δ. Here, the first reference value δ may be one real value.

The base station 410 may transmit different types of signals in the subcarriers included in the first subcarrier set $S_D$ and the subcarriers included in the second subcarrier set $S_J$. For example, the base station 410 may transmit data symbols including data to be transmitted to the terminal 420 through the subcarriers included in the first subcarrier set $S_D$. The first subcarrier set $S_D$ may correspond to a data subcarrier set. On the other hand, the base station 410 may transmit dummy symbols or jamming symbols through the subcarriers included in the second subcarrier set $S_J$. The second subcarrier set $S_J$ may correspond to a jamming subcarrier set. The data symbols transmitted through the first subcarrier set $S_D$ and the dummy symbols transmitted through the second subcarrier set $S_J$ may be symbols modulated using the same modulation scheme. For example, the data symbols and dummy symbols may be symbols modulated by a phase shift keying (PSK) scheme or a quadrature amplitude modulation (QAM) scheme.

The first reference value δ may be determined according to a data rate required for signal transmission and reception between the base station 410 and the terminal 420 as described above. As the number of subcarriers included in the first subcarrier set $S_D$ increases, the data rate may increase. Meanwhile, as the number of subcarriers included in the second subcarrier set $S_J$ decreases, the data rate may increase. That is, as the required data rate increases, the first reference value δ may be set to a higher value. On the other hand, as the required data rate is lower, the first reference value δ may be set to a lower value.

The base station 410 may transmit information of the first reference value δ to the terminal 420. The base station 410 and the terminal 420 may identify the information of the first reference value δ and information of the radio channel h. Accordingly, the terminal 420 may decode the signal transmitted from the base station 410 based on the information of the first reference value δ and the information of the radio channel h.

Meanwhile, the eavesdropper node 430 may find out the information of the first reference value δ through eavesdropping, but may not accurately identify information of the first reference subcarrier k* and the radio channel h. The eavesdropper node 430 may attempt to decode the signal transmitted from the base station 410 based on information of an arbitrary reference subcarrier $\bar{k}$ and the radio channel $g_a$. In this case, the eavesdropper node 430 may classify a data subcarrier set $\widehat{S_D}$ and a jamming subcarrier set as $\hat{S}_J$ shown in Equations 7 and 8, respectively.

$$\widehat{S_D}=\{k \mid |\phi_k-\phi_{\bar{k}}|\leq\delta\} \quad \text{[Equation 7]}$$

$$\hat{S}_J=\{k \mid |\phi_k>\phi_{\bar{k}}|>\delta\} \quad \text{[Equation 8]}$$

Even when the eavesdropper node 430 classifies the data subcarrier set $\widehat{S_D}$ and the jamming subcarrier set as shown in Equations 7 and 8, the results thereof may not be expected to be the same as those of Equations 5 and 6. The arbitrary reference subcarrier k used by the eavesdropper node 430 may be different from the first reference subcarrier k* used by the base station 410. In addition, the phase $\phi_k$ of each subcarrier of the radio channel $g_a$ may be different from the phase $\theta_k$ of each subcarrier of the radio channel h. Even when a case where $k^*=\bar{k}$ and $\theta_{k^*}=\phi_{\bar{k}}$ as a coincidence is assumed, since $\phi_k$ and $\theta_k$ are different from each other, $\widehat{S_D}$ and $\hat{S}_J$ may be different from the first subcarrier set $S_D$ and the second subcarrier set $S_J$. That is, the eavesdropper node 430 may not properly decode the radio signal transmitted from the base station 410. Accordingly, the base station 410 and the terminal 420 may perform wireless communication with security without pre-sharing a separate security key.

Meanwhile, the first reference subcarrier number k* may be determined as in Equation 9.

$$k^* = \arg\max_k |H(k)| \quad \text{[Equation 9]}$$

The phase of the first reference subcarrier determined through Equation 9 may be referred to as $\theta_{k^*}$. Here, a first phase value $\theta_k'$ may be defined based on $\theta_{k^*}$, a phase $\theta_k$ of each subcarrier, and a second reference value Δ pre-shared between the base station 410 and the terminal 420. For example, $\theta_k'$ may be defined as in Equation 10.

$$\theta_k'=\theta_k+(\Delta-\theta_{k^*}),k=0,1,\ldots,N-1 \quad \text{[Equation 10]}$$

Here, the second reference value Δ is a value pre-shared between the base station 410 and the terminal 420, and security may not be deteriorated even when it is leaked to the eavesdropper node 430. Based on the second reference value Δ and the first phase value $\theta_k'$, a second phase value $\hat{\theta}_k$ having a value between 0 and 2π may be defined. For example, $\hat{\theta}_k$ may be defined as in Equation 11.

$$\hat{\theta}_k=2\pi-|\theta_k'-\Delta| \quad \text{[Equation 11]}$$

Based on Equation 10 and Equation 11, the second phase value $\hat{\theta}_k$ may be expressed as Equation 12.

$$\hat{\theta}_k=2\pi-|\theta_k-\theta_{k^*}|,k=0,1,\ldots,N-1 \quad \text{[Equation 12]}$$

The second phase value $\hat{\theta}_k$ may be set to have a value between 0 and 2π based on a difference between the phase $\theta_k$ of each subcarrier and the phase $\theta_{k^*}$ of the first reference subcarrier. The first reference value δ may be calculated based on the second phase value $\hat{\theta}_k$ defined according to Equation 11 or Equation 12. The first reference value δ may be calculated according to an operation of each subcarrier unit. Hereinafter, a method of calculating the first reference value δ will be described with reference to FIGS. 5 and 6.

FIG. 5 is a diagram for describing a first exemplary embodiment of a method for calculating a first reference value according to the present disclosure. The first exemplary embodiment of the method for calculating the first reference value described with reference to FIG. 5 may be performed in the first exemplary embodiment of the secure communication system according to the present disclosure described with reference to FIG. 4. Descriptions redundant with those described in FIG. 4 will be omitted.

Referring to FIG. 5, the first reference value δ may be calculated based on a data rate required for signal transmission and reception between the base station and the terminal, channel information of the radio channel, and the like. The first reference value δ may be calculated through an algorithm based on a bisection method. The bisection method may refer to a method of finally finding a solution by dividing a section in which a solution exists into two sub-sections, and then selecting a sub-section in which a solution exists among them. The data rate required for signal transmission and reception between the base station and the terminal may be referred to as a required data rate $R_{req}$.

In the algorithm based on the bisection method, first, a plurality of initial conditions may be set. For example, initial conditions of a first variable $\delta_{max}$ and a second variable $\delta_{min}$ may be set to 2π and 0, respectively (S510). Here, $\delta_{max}$ and $\delta_{min}$ may mean variables indicating the maximum and minimum values of a setting range of the first reference value δ, respectively. $R_{max}$ may be set based on Shannon's channel capacity formula (S520). Here, $R_{max}$ may mean a theoretical maximum data rate in the radio channel between the base station and the terminal, which is calculated based on the Shannon channel capacity theory. $R_{max}$ may be, for example, Equation 13.

$$R_{max} = \frac{1}{N}\sum_{k=0}^{N-1}\log_2(1+\eta|H(k)|^2) \quad \text{[Equation 13]}$$

Further, based on $R_{max}$ and $R_{req}$, a third variable R may be additionally set (S530). Here, an initial condition of the third variable R may be set as a difference between the theoretically possible maximum data rate $R_{max}$ in the channel between the base station and the terminal and the data rate $R_{req}$ required in the channel between the base station and the terminal. The initial condition of the third variable R may be set as shown in Equation 14.

$$R=R_{max}-R_{req} \quad \text{[Equation 14]}$$

The algorithm for calculating the first reference value δ may be implemented by repeatedly performing a plurality of operations according to the bisection method. Such the iterative operation may be performed in a section in which a difference between the first variable $\delta_{max}$ and the second variable $\delta_{min}$ is greater than a first threshold value d (S540). The first threshold d is a kind of accuracy threshold, and as the value of the first threshold d is set smaller, more precise calculation may be performed, but the efficiency of the algorithm may decrease due to an increase in the computational amount. On the other hand, as the value of the first threshold d is set larger, the computational amount decreases, so that the efficiency of the algorithm may be improved, but the precision of the operation may be deteriorated.

A fourth variable $\bar{\delta}$ may be defined based on the difference between the first variable $\delta_{max}$ and the second variable $\delta_{min}$ (S550). For example, the fourth variable $\bar{\delta}$ may be defined as in Equation 15.

$$\bar{\delta} = \frac{\delta_{max}-\delta_{min}}{2} \quad \text{[Equation 15]}$$

Thereafter, the first subcarrier set $S_D$ may be defined based on the second phase value $\hat{\theta}_k$ and the fourth variable $\bar{\delta}$ (S560). For example, the first subcarrier set $S_D$ may be defined as a set of subcarriers whose second phase value $\hat{\theta}_k$ is smaller than the fourth variable $\bar{\delta}$. The first subcarrier set $S_D$ may be defined as in Equation 16.

$$S_D=\{k|\hat{\theta}_k<\bar{\delta}\} \quad \text{[Equation 16]}$$

Thereafter, the third variable R may be newly defined based on the first subcarrier set $S_D$ (S570). The newly defined third variable R may mean the maximum data rate through the first subcarrier set $S_D$ calculated based on the Shannon channel capacity formula. For example, the third variable R may be defined as in Equation 17.

$$R = \frac{1}{N}\sum_{k\in S_D}\log_2(1+\eta|H(k)|^2) \quad \text{[Equation 17]}$$

Here, the first variable $\delta_{max}$ or the second variable $\delta_{min}$ may be newly defined according to a result of the comparison between the third variable R and the required data rate $R_{req}$ (S580). When the third variable R is greater than or equal to the required data rate $R_{req}$, the value of the second variable $\delta_{min}$ may be defined as the same value as the fourth variable $\bar{\delta}$. On the other hand, when the third variable R is less than the required data rate $R_{req}$, the value of the first variable $\delta_{max}$ may be defined as the same value as the fourth variable $\bar{\delta}$.

When the difference between the first variable $\delta_{max}$ and the second variable $\delta_{min}$ after the step S580 is greater than the first threshold value d, the operation of steps S550 to S580 may be performed again (S540). Meanwhile, when the difference between the first variable $\delta_{max}$ and the second variable $\delta_{min}$ after the step S580 is less than or equal to the first threshold value d, the iterative operation may be terminated.

Here, the first reference value δ may be calculated based on the finally-defined first subcarrier set $S_D$ (S590). For example, in the finally-defined first subcarrier set $S_D$, the maximum value of the difference between the phase $\theta_k$ of each subcarrier and the phase $\theta_{k*}$ of the first reference subcarrier may be defined as the first reference value δ.

FIG. 6 is a diagram for describing a second exemplary embodiment of a method for calculating a first reference value according to the present disclosure. The second exemplary embodiment of the method for calculating the first reference value described with reference to FIG. 6 may be partially similar to the first exemplary embodiment of the method for calculating the first reference value described with reference to FIG. 5. Descriptions redundant with those described in FIG. 5 will be omitted.

Referring to FIG. 6, the first reference value δ may be calculated based on the data rate required for signal transmission and reception between the base station and the terminal, channel information of the radio channel, and the like. The first reference value δ may be calculated through the algorithm based on the bisection method. In the algorithm based on the bisection method, first, a plurality of initial conditions may be set. For example, initial conditions of the first variable $\delta_{max}$ and the second variable $\delta_{min}$ may be set to 2π (and 0, respectively (S610). The maximum data rate $R_{max}$ may be set based on a modulation order M according to a Modulation and Coding Scheme (MCS), a code rate C, and the number N of subcarriers (S620). The maximum data rate $R_{max}$ may be, for example, Equation 18.

$$R_{max}=NMC \quad \text{[Equation 18]}$$

Also, based on the maximum data rate $R_{max}$ and the required data rate $R_{req}$, the third variable R may be additionally set (S630). The initial condition of the third variable R may be set as in Equation 19.

$$R=R_{max}R_{req} \quad \text{[Equation 19]}$$

The algorithm for calculating the first reference value δ may be implemented by repeatedly performing a plurality of operations according to the bisection method.

Such the iterative operation may be performed in a section in which a difference between the first variable $\delta_{max}$ and the second variable $\delta_{min}$ is greater than the first threshold value d (S640).

The fourth variable $\bar{\delta}$ may be defined based on the difference between the first variable $\delta_{max}$ and the second variable $\delta_{min}$ (S650). For example, the fourth variable $\bar{\delta}$ may be defined as in Equation 20.

$$\bar{\delta} = \frac{\delta_{max} - \delta_{min}}{2} \quad \text{[Equation 20]}$$

Thereafter, the first subcarrier set $S_D$ may be defined based on the second phase value $\hat{\theta}_k$ and the fourth variable $\bar{\delta}$ (S660). The first subcarrier set $S_D$ may be defined as in Equation 21.

$$S_D=\{k|\hat{\theta}_k<\bar{\delta}\} \quad \text{[Equation 21]}$$

Thereafter, the third variable R may be newly defined based on the first subcarrier set $S_D$ (S670). The newly defined third variable R may be set based on a modulation order M according to an MCS, a code rate C, and the number $n(S_D)$ of subcarriers included in the first subcarrier set $S_D$. For example, the third variable R may be defined as in Equation 22.

$$R=n(S_D)MC \quad \text{[Equation 22]}$$

Here, the first variable $\delta_{max}$ or the second variable $\delta_{min}$ may be newly defined according to a result of the comparison between the third variable R and the required data rate $R_{req}$ (S680). When the third variable R is greater than or equal to the required data rate $R_{req}$, the value of the second variable $\delta_{min}$ may be defined as the same value as the fourth variable $\bar{\delta}$. On the other hand, when the third variable R is less than the required data rate $R_{req}$, the value of the first variable $\delta_{max}$ may be defined as the same value as the fourth variable $\bar{\delta}$.

When the difference between the first variable $\delta_{max}$ and the second variable $\delta_{min}$ after the step S680 is greater than the first threshold value d, the operation of steps S650 to S680 may be performed again (S640). Meanwhile, when the difference between the first variable $\delta_{max}$ and the second variable $\delta_{min}$ after the step S680 is less than or equal to the first threshold value d, the iterative operation may be terminated.

Here, the first reference value δ may be calculated based on the finally-defined first subcarrier set $S_D$ (S690). For example, in the finally-defined first subcarrier set $S_D$, the maximum value of the difference between the phase $\theta_k$ of each subcarrier and the phase $\theta_{k*}$ of the first reference subcarrier may be defined as the first reference value δ.

Referring again to FIG. 4, the second exemplary embodiment of the secure communication system according to the present disclosure will be described. A description that is redundant with those described with respect to the first exemplary embodiment of the secure communication system according to the present disclosure will be omitted.

The secure communication system 400 may secure security between the base station 410 and the terminal 420 based on information of the radio channel h from the base station 410 to the terminal 420 and information of the radio channel $g_a$ through which the eavesdropper node 430 receives the signal from the base station 410. The radio channel h may be expressed as H of Equation 23 in the frequency domain.

$$H = \begin{bmatrix} H_0(0) & \dots & H_{L-1} \\ \vdots & \ddots & \vdots \\ H_0(N-1) & \dots & H_{L-1}(N-1) \end{bmatrix} \quad \text{[Equation 23]}$$

In Equation 23, L may mean the number of OFDM symbols included in one slot. N may mean the number of subcarriers of each OFDM symbol. $H_m(k)$ may mean the k-th subcarrier of the m-th OFDM symbol within one slot. $H_m(k)$ may be expressed as Equation 24.

$$H_m(k)=|H_m(k)|e^{j\theta_{m,k}}, m=0,1, \dots L-1, k=0,1, \dots, N-1 \quad \text{[Equation 24]}$$

In Equation 24, $\theta_{m,k}$ may mean a phase of $H_m(k)$.

The base station 410 may select any one of the L OFDM symbols and set it as a first reference symbol. The first reference symbol selected in this manner may be referred to as m*. The base station 410 may select any one of the N subcarriers of the first reference symbol m* and set it as a first reference subcarrier. The first reference subcarrier selected as described above may be referred to as k*. Only the base station 410 has information on the first reference symbol and the first reference subcarrier, and the information may not be transferred to the terminal 420. The base station 410 may determine two symbol-subcarrier sets (or, resource element sets) based on m* and k*. The base station 410 may determine a first symbol-subcarrier set $S_D$ and a second symbol-subcarrier set $S_J$ based on m* and k*. The first symbol-subcarrier set $S_D$ and the second symbol-subcarrier set $S_J$ may be expressed as Equations 25 and 26, respectively.

$$S_D=\{(m,k)||\theta_{m,k}-\theta_{m*,k*}|\leq\delta\} \quad \text{[Equation 25]}$$

$$S_J=\{(m,k)||\theta_{m,k}-\theta_{m*,k*}|>\delta\} \quad \text{[Equation 26]}$$

The base station 410 may transmit data symbols including data to be transmitted to the terminal 420 through resources included in the first symbol-subcarrier set $S_D$. Meanwhile, the base station 410 may transmit dummy symbols or jamming symbols through subcarriers included in the second symbol-subcarrier set $S_J$.

The base station 410 may transmit information of the first reference value δ to the terminal 420. The base station 410 and the terminal 420 may identify the information of the first reference value δ and information of the radio channel h. Accordingly, the terminal 420 may decode the signal transmitted from the base station 410 based on the information of the first reference value δ and the information of the radio channel h.

Meanwhile, the eavesdropper node 430 may find out the information of the first reference value δ through eavesdropping, but may not accurately identify the information of the first reference symbol m* and the first reference subcarrier k* and the information of the radio channel h. The eavesdropper node 430 may attempt to decode the signal transmitted from the base station 410 based on information of an arbitrary reference symbol $\bar{m}$, an arbitrary reference subcarrier k, and the radio channel $g_a$. In this case, the eavesdropper node 430 may classify a data symbol-subcarrier set $\hat{S_D}$ and a jamming symbol-subcarrier set $\hat{S}_J$ as shown in Equations 27 and 28, respectively.

$$\hat{S_D}=\{(m,k)||\phi_{m,k}-\phi_{\bar{m},\bar{k}}|\leq\delta\} \quad \text{[Equation 27]}$$

$$\hat{S}_J=\{(m,k)||\phi_{m,k}-\phi_{\bar{m},\bar{k}}|>\delta\} \quad \text{[Equation 28]}$$

Even when the eavesdropper node 430 classifies $\hat{S_D}$ and $\hat{S}_J$ as in Equations 27 and 28, the results thereof may not be expected to be the same as those of Equations 25 and 26. The arbitrary reference symbol $\bar{m}$ and the arbitrary reference subcarrier k used by the eavesdropper node 430 may be different from the first reference subcarrier m* and the first reference subcarrier k* used by the base station 410. In addition, the phase $\phi_{m,k}$ of each subcarrier of the radio channel $g_a$ may be different from the phase $\theta_{m,k}$ of each subcarrier of the radio channel h. Even when a case where $m^*=\bar{m}$, $k^*=\bar{k}$, and $\theta_{k*}=\phi_{\bar{k}}$ as a coincidence is assumed, since $\phi_{m,k}$ and $\theta_{m,k}$ are different from each other, $\hat{S_D}$ and $\hat{S}_J$ may be different from the first symbol-subcarrier set $S_D$ and the second symbol-subcarrier set $S_J$. That is, the eavesdropper node 430 may not properly decode the radio signal transmitted from the base station 410. Accordingly, the base station 410 and the terminal 420 may perform wireless communication with security without pre-sharing a separate security key.

Meanwhile, the first reference symbol m* and the first reference subcarrier k* may be determined as in Equation 29.

$$(m^*, k^*) = \underset{m,k}{\operatorname{argmax}} |H_m(k)| \quad \text{[Equation 29]}$$

Here, based on $\theta_{m^*k^*}$ and $\theta_{m,k}$ determined through Equation 29 and the second reference value Δ pre-shared between the base station 410 and the terminal 420, the first phase value $\theta_{m\ k}'$ may be defined. For example, $\theta_{m,k}'$ may be defined as in Equation 30.

$$\theta_{m,k}'=\theta_{m,k}+(\Delta-\theta_{m^*,k^*}), m=0,1, \ldots, L-1, k=0, 1, \ldots, N-1 \quad \text{[Equation 30]}$$

Here, the second reference value Δ is a value pre-shared between the base station 410 and the terminal 420, and security may not be deteriorated even when it is leaked to the eavesdropper node 430. Based on the second reference value Δ and the first phase value $\theta_{m,k}'$, the second phase value $\hat{\theta}_{m,k}$ having a value between 0 and 2π may be defined. For example, $\hat{\theta}_{m,k}$ may be defined as in Equation 31.

$$\hat{\theta}_{m,k}=2\pi-|\theta_{m,k}'-\Delta| \quad \text{[Equation 31]}$$

Based on Equation 30 and Equation 31, the second phase value $\hat{\theta}_{m,k}$ may be expressed as Equation 32.

$$\hat{\theta}_{m,k}=2\pi-|\theta_{m,k}-\theta_{m^*,k^*}|, k=0,1, \ldots, N-1 \quad \text{[Equation 32]}$$

The second phase value $\hat{\theta}_{m,k}$ may be set to have a value between 0 and 2π based on a difference between the phase $\theta_{m,k}$ of each subcarrier and the phase $\theta_{m^*,k^*}$ of the first reference subcarrier. The first reference value δ may be calculated based on the second phase value $\hat{\theta}_{m,k}$ defined according to Equation 31 or Equation 32. The first reference value δ may be calculated according to an operation of each OFDM symbol unit. Hereinafter, a method of calculating the first reference value δ will be described with reference to FIGS. 7 and 8.

FIG. 7 is a diagram for describing a third exemplary embodiment of a method for calculating a first reference value according to the present disclosure. The third exemplary embodiment of the method for calculating the first reference value described with reference to FIG. 7 may be performed in the second exemplary embodiment of the secure communication system according to the present disclosure described with reference to FIG. 4. Descriptions redundant with those described in FIG. 4 will be omitted. Hereinafter, the third exemplary embodiment of the method for calculating the first reference value described with reference to FIG. 7 may be partially similar to the first exemplary embodiment of the method for calculating the first reference value described with reference to FIG. 5. Descriptions redundant with those described in FIG. 5 will be omitted.

Referring to FIG. 7, the first reference value δ may be calculated based on the data rate required for signal transmission and reception between the base station and the terminal, channel information of the radio channel, and the like. The first reference value δ may be calculated through an algorithm based on the bisection method.

In the algorithm based on the bisection method, first, a plurality of initial conditions may be set. For example, initial conditions of the first variable $\delta_{max}$ and the second variable $\delta_{min}$ may be set to 2π and 0, respectively (S710). The maximum data rate $R_{max}$ may be set based on the Shannon channel capacity formula (S720). The maximum data rate $R_{max}$ may be, for example, Equation 33.

$$R_{max} = \frac{1}{NL}\sum_{m=0}^{L-1}\sum_{k=0}^{N-1}\log_2(1+\eta|H(m,k)|^2) \quad \text{[Equation 33]}$$

Also, based on the maximum data rate $R_{max}$ and the required data rate $R_{req}$, the third variable R may be additionally set (S730). The initial condition of the third variable R may be set as in Equation 34.

$$R=_{max}-R_{req} \quad \text{[Equation 34]}$$

The algorithm for calculating the first reference value δ may be implemented by repeatedly performing a plurality of operations according to the bisection method. Such the iterative operation may be performed in a section in which a difference between the first variable $\delta_{max}$ and the second variable $\delta_{min}$ is greater than the first threshold value d (S740).

The fourth variable $\bar{\delta}$ may be defined based on the difference between the first variable $\delta_{max}$ and the second variable $\delta_{min}$ (S750). For example, the fourth variable $\bar{\delta}$ may be defined as in Equation 35.

$$\bar{\delta} = \frac{\delta_{max}-\delta_{min}}{2} \quad \text{[Equation 35]}$$

Thereafter, a first symbol-subcarrier set $S_D$ may be defined based on the second phase value $\hat{\theta}_{m,k}$ and the fourth variable $\bar{\delta}$ (S760). The first symbol-subcarrier set $S_D$ may be defined as in Equation 36.

$$S_D=\{(m,k)|\hat{\theta}_{m,k}<\bar{\delta}\} \quad \text{[Equation 36]}$$

Thereafter, the third variable R may be newly defined based on the first symbol-subcarrier set $S_D$ (S770). The newly defined third variable R may be mean the maximum data rate through the first symbol-subcarrier set $S_D$, which is calculated based on the Shannon channel capacity formula. For example, the third variable R may be defined as in Equation 37.

$$R = \frac{1}{NL}\sum_{(m,k)\in S_D}\log_2(1+\eta|H_m(k)|^2) \quad \text{[Equation 37]}$$

Here, the first variable $\delta_{max}$ or the second variable $\delta_{min}$ may be newly defined according to a result of the comparison between the third variable R and the required data rate $R_{req}$ (S780). When the third variable R is greater than or equal to the required data rate $R_{req}$, the value of the second variable $\delta_{min}$ may be defined as the same value as the fourth variable $\bar{\delta}$. On the other hand, when the third variable R is less than the required data rate $R_{req}$, the value of the first variable $\delta_{max}$ may be defined as the same value as the fourth variable $\bar{\delta}$.

When the difference between the first variable $\delta_{max}$ and the second variable $\delta_{min}$ after the step S780 is greater than the first threshold value d, the operation of steps S750 to S780 may be performed again (S740). Meanwhile, when the difference between the first variable $\delta_{max}$ and the second variable $\delta_{min}$ after the step S780 is less than or equal to the first threshold value d, the iterative operation may be terminated.

Here, the first reference value δ may be calculated based on the finally-defined first symbol-subcarrier set $S_D$ (S790). For example, in the finally-defined first symbol-subcarrier set $S_D$, the maximum value of the difference between the phase $\theta_{m,k}$ of each subcarrier and the phase $\theta_{m^*,k^*}$ of the first reference subcarrier may be defined as the first reference value δ.

FIG. 8 is a diagram for describing a fourth exemplary embodiment of a method for calculating a first reference value according to the present disclosure. The fourth exemplary embodiment of the method for calculating the first reference value described with reference to FIG. 8 may be partially similar to the third exemplary embodiment of the method for calculating the first reference value described with reference to FIG. 7. Descriptions redundant with those described in FIG. 7 will be omitted.

Referring to FIG. 8, the first reference value δ may be calculated based on the data rate required for signal transmission and reception between the base station and the terminal, channel information of the radio channel, and the like. The first reference value δ may be calculated through an algorithm based on the bisection method.

In the algorithm based on the bisection method, first, a plurality of initial conditions may be set. For example, initial conditions of the first variable $\delta_{max}$ and the second variable $\delta_{min}$ may be set to 2n and 0, respectively (S810). The maximum data rate $R_{max}$ may be set based on a modulation order M according to an MCS, a code rate C, the number L of symbols constituting each slot, and the number N of subcarriers that each symbol has (S820). The maximum data rate $R_{max}$ may be, for example, Equation 38.

$$R_{max}=\text{NLMC} \quad \text{[Equation 38]}$$

Also, based on the maximum data rate $R_{max}$ and the required data rate $R_{req}$, the third variable R may be additionally set (S830). The initial condition of the third variable R may be set as in Equation 39.

$$R=R_{max}-R_{req} \quad \text{[Equation 39]}$$

The algorithm for calculating the first reference value δ may be implemented by repeatedly performing a plurality of operations according to the bisection method.

Such the iterative operation may be performed in a section in which a difference between the first variable $\delta_{max}$ and the second variable $\delta_{min}$ is greater than the first threshold value d (S840).

The fourth variable δ may be defined based on the difference between the first variable $\delta_{max}$ and the second variable $\delta_{min}$ (S850). For example, the fourth variable $\bar{\delta}$ may be defined as in Equation 40.

$$\bar{\delta}=\frac{\delta_{max}-\delta_{min}}{2} \quad \text{[Equation 40]}$$

Thereafter, a first symbol-subcarrier set $S_D$ may be defined based on the second phase value $\hat{\theta}_{m,k}$ and the fourth variable $\bar{\delta}$ (S860). The first symbol-subcarrier set $S_D$ may be defined as in Equation 41.

$$S_D=\{(m,k)|\hat{\theta}_{m,k}<\bar{\delta}\} \quad \text{[Equation 41]}$$

Thereafter, the third variable R may be newly defined based on the first symbol-subcarrier set $S_D$ (S870). The newly defined third variable R may be set based on a modulation order M according to an MCS, a code rate C, and the number $n(S_D)$ of symbol-subcarrier pairs included in the first symbol-subcarrier set $S_D$. For example, the third variable R may be defined as in Equation 42.

$$R=n(S_D)MC \quad \text{[Equation 42]}$$

Here, the first variable $\delta_{max}$ or the second variable $\delta_{min}$ may be newly defined according to a result of the comparison between the third variable R and the required data rate $R_{req}$ (S880). When the third variable R is greater than or equal to the required data rate $R_{req}$, the value of the second variable $\delta_{min}$ may be defined as the same value as the fourth variable $\bar{\delta}$. On the other hand, when the third variable R is less than the required data rate $R_{req}$, the value of the first variable $\delta_{max}$ may be defined as the same value as the fourth variable $\bar{\delta}$.

When the difference between the first variable $\delta_{max}$ and the second variable $\delta_{min}$ after the step S880 is greater than the first threshold value d, the operation of steps S850 to S880 may be performed again (S840). Meanwhile, when the difference between the first variable $\delta_{max}$ and the second variable $\delta_{min}$ after the step S880 is less than or equal to the first threshold value d, the iterative operation may be terminated.

Here, the first reference value δ may be calculated based on the finally-defined first symbol-subcarrier set $S_D$ (S890). For example, in the finally-defined first symbol-subcarrier set $S_D$, the maximum value of the difference between the phase $\theta_{m,k}$ of each subcarrier and the phase $\theta_{m^*,k^*}$ of the first reference subcarrier may be defined as the first reference value δ.

Figure 9:
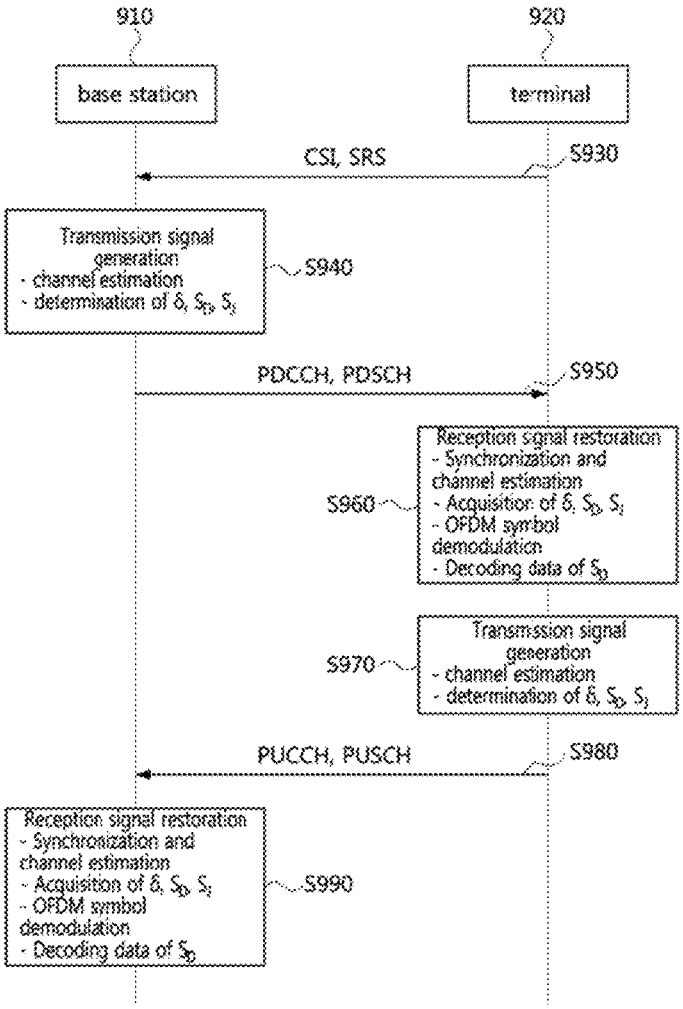
FIG. 9 is a sequence chart illustrating an exemplary embodiment of signal flows between communication nodes in a secure communication system according to the present disclosure.

FIG. 9 is a sequence chart illustrating an exemplary embodiment of signal flows between communication nodes in a secure communication system according to the present disclosure.

Referring to FIG. 9, the secure communication system according to the present disclosure may be the same as or similar to the first exemplary embodiment or the second exemplary embodiment of the secure communication system 400 described with reference to FIG. 4. The secure communication system may include a plurality of communication nodes. The secure communication system may be a communication system to which the cellular communication scheme described with reference to FIG. 1 is applied. FIG. 9 illustrates an exemplary embodiment in which a plurality of communication nodes are a base station and a terminal, but this is only an example for convenience of description. For example, the secure communication system may be a communication system to which the wireless LAN communication scheme described with reference to FIG. 2 is applied.

The secure communication system may include a base station 910 and a terminal 920. The terminal 920 may transmit a signal for channel estimation to the base station 910 (S930). For example, the terminal 920 may transmit channel state information (CSI) feedback to the base station 910 for channel estimation by the base station 910. The terminal 920 may transmit the CSI feedback to the base station 910 based on a state of a downlink channel previously received from the base station 910. Alternatively, the terminal 920 may transmit a sounding reference signal (SRS) to the base station 910 to perform channel estimation with the base station 910. The terminal 920 may estimate a radio channel with the base station 910 based on a signal returned based on the SRS received by the base station 910.

The base station 910 may perform a transmission signal generation phase (i.e., Tx signal generation phase) or a transmission signal generation operation (S940). In the transmission signal generation phase, the base station 910 may generate a signal to be transmitted to the terminal 920. The base station 910 may perform channel estimation with the terminal 920. The base station 910 may perform channel estimation based on an uplink signal received from the terminal 920. For example, the base station 910 may estimate a radio channel based on the CSI feedback received from the terminal 920.

The base station 910 may determine the first reference value δ, the first subcarrier set $S_D$, and the second subcarrier set $S_J$ based on channel information of the estimated radio channel. The base station 910 may determine the first reference value δ based on the channel information of the estimated radio channel, the data rate required for signal transmission and reception with the terminal 920, and the like. The base station 910 may determine two subcarrier sets based on the channel information and the first reference value δ. For example, the base station 910 may determine the first reference value δ, the first subcarrier set $S_D$, and the second subcarrier set $S_J$ in the same or similar manner as described with reference to FIG. 5 or 6. Alternatively, the base station 910 may determine the first reference value δ, the first subcarrier set $S_D$, and the second subcarrier set $S_J$ in the same or similar manner as described with reference to FIG. 7 or 8. The base station 910 may generate OFDM symbols based on the determined $S_D$ and $S_J$. The base station 910 may allocate a data signal and a jamming signal to the determined $S_D$ and $S_J$, respectively.

When the transmission signal generation is completed, the base station 910 may transmit the transmission signal to the terminal 920 (S950). The base station 910 may transmit a Physical Downlink Control Channel (PDCCH) and a Physical Downlink Shared Channel (PDSCH) to the terminal 920. The base station 910 may transmit a control signal used to restore the transmission signal at the terminal 920 to the terminal 920 through the PDCCH. The base station 910 may transmit the OFDM signals generated in the step S940 to the terminal 920 through the PDSCH.

The base station 910 may transmit downlink control information (DCI) to the terminal 920 through the PDCCH. The base station 910 may transmit a message indicating whether to apply the method according to the present disclosure and a message indicating the first reference value δ using a part of reserved bits of the DCI transmitted to the terminal 920. For example, the base station 910 may transmit the DCI, which is transmitted to the terminal 920, by including a 'PHYSECind' message, which is a 1-bit message indicating whether to apply the method according to the present disclosure. Meanwhile, the base station 910 may transmit the DCI, which is transmitted to the terminal 920, by including a 'Delta' message that is a real value message of 1 to 2 bytes indicating the first reference value δ. In the above, the exemplary embodiment of the present disclosure has been described using the DCI of the cellular communication system as an example. However, this is only an example for convenience of description, and the present disclosure is not limited thereto. For example, a communication system according to another exemplary embodiment of the present disclosure may be a wireless LAN communication system. For example, the 'PHYSECind' message or the 'Delta' message described above as an example may be transmitted from a first communication node to a second communication node through a SIG field (e.g., L-SIG or VHT-SIG) defined in the wireless LAN or Wi-Fi communication specifications.

The terminal 920 may perform an Rx signal recovery phase or a reception signal recovery operation (S960). The terminal 920 may receive the PDCCH and the PDSCH from the base station 910. The terminal 920 may restore a reception signal received from the base station 910.

In the reception signal recovery phase, the terminal 920 may perform channel estimation with the base station 910. The terminal 920 may perform channel estimation based on a downlink signal received from the base station 910. For example, the terminal 920 may estimate the radio channel based on the feedback returned by the base station 910 with respect to the SRS signal transmitted in the step S930.

The terminal 920 may perform restoration of the PDSCH based on the information included in the PDCCH received from the base station 910. The terminal 920 may perform the restoration of the PDSCH based on the message included in the DCI received from the base station 910 through the PDCCH. For example, the terminal 920 may identify whether the method according to the present disclosure is applied based on the message indicating whether the method according to the present disclosure is applied or not, which is included in the DCI. When it is not indicated to apply the method according to the present disclosure, the terminal 920 may restore the PDSCH according to the conventional scheme. On the other hand, when it is indicated to apply the method according to the present disclosure, the terminal 920 may perform the restoration of the PDSCH based on the estimated channel information and the first reference value δ obtained from the DCI.

The terminal 920 may determine $S_D$ and $S_J$ based on the channel information and the first reference value δ. Alternatively, the terminal 920 may determine $S_D$ and $S_J$ according to the same or similar scheme as described with reference to any one of FIGS. 5 to 8. The terminal 920 may classify OFDM symbols received through the PDSCH into symbols received through $S_D$ and symbols received through $S_J$. The terminal 920 may not decode the symbols received through the $S_J$ as it determines that they correspond to the jamming signal. On the other hand, the terminal 920 may determine that the symbols received through the $S_D$ correspond to the data signal and decode them.

The terminal 920 may further perform a demodulation operation on the received OFDM symbols before performing decoding. The terminal 920 may perform operations such as cyclic prefix (CP) removal, fast Fourier transform (FFT), or channel estimation through the demodulation operation. The terminal 920 may perform classification and selective decoding operations on the demodulated signals.

The terminal 920 may perform a transmission signal generation phase (i.e., Tx signal generation phase) or a transmission signal generation operation (S970). In the transmission signal generation phase, the terminal 920 may generate a signal to be transmitted to the base station 910. The terminal 920 may perform channel estimation with the base station 910. Alternatively, the terminal 920 may perform the transmission signal generation based on the channel information previously estimated through the step S960 or the like.

The terminal 920 may determine the first reference value δ, the first subcarrier set $S_D$, and the second subcarrier set $S_J$ based on the channel information of the estimated radio channel. The terminal 920 may determine the first reference value δ based on the channel information of the estimated radio channel and a data rate required for signal transmission and reception with the base station 910. The terminal 920 may determine the two subcarrier sets based on the channel information and the first reference value δ. For example, the terminal 920 may determine the first reference value δ, the first subcarrier set $S_D$, and the second subcarrier set $S_J$ in the same or similar manner as described with reference to FIG. 5 or 6. Alternatively, the terminal 920 may determine the first reference value δ, the first symbol-subcarrier set $S_D$, and the second symbol-subcarrier set $S_J$ in the same or similar manner as described with reference to FIG. 7 or 8. The terminal 920 may generate OFDM symbols based on the determined $S_D$ and $S_J$. The terminal 920 may allocate a data signal and a jamming signal to the determined $S_D$ and $S_J$, respectively.

When the transmission signal generation is completed, the terminal 920 may transmit the transmission signal to the base station 910 (S980). The terminal 920 may transmit a Physical Uplink Control Channel (PUCCH) and a Physical Uplink Shared Channel (PUSCH) to the base station 910. The terminal 920 may transmit a control signal used by the base station 910 to restore the transmission signal to the base station 910 through the PUCCH. The terminal 920 may transmit the OFDM signals generated in the step S970 to the base station 910 through the PUSCH.

The terminal 920 may transmit uplink control information (UCI) to the base station 910 through the PUCCH. The terminal 920 may transmit a message indicating the first reference value δ to the base station 910 by using a part of reserved bits of the UCI transmitted to the base station 910. For example, the terminal 920 may transmit the UCI, which is transmitted to the base station 910, by including a 'Delta' message that is a real value message of 1 to 2 bytes indicating the first reference value δ. The exemplary embodiment of the present disclosure has been described above by taking the UCI of the cellular communication system as an example. However, this is only an example for convenience of description, and the present disclosure is not limited thereto. For example, the communication system according to another exemplary embodiment of the present disclosure may be a communication system based on the wireless LAN communication scheme. For example, the 'Delta' message described above as an example may be transmitted from a first communication node to a second communication node through a SIG field (e.g., L-SIG, or VHT-SIG) defined in the wireless LAN or Wi-Fi communication specifications.

The base station 910 may perform an Rx signal recovery phase or a reception signal recovery operation (S990). The base station 910 may receive the PUCCH and the PUSCH from the terminal 920. The base station 910 may restore the signals received from the terminal 920.

In the reception signal recovery phase, the base station 910 may perform a channel estimation and synchronization operation with the terminal 920. The base station 910 may perform channel estimation based on an uplink signal received from the terminal 920. Alternatively, the base station 910 may perform the reception signal recovery phase based on the channel information previously estimated through the step S940.

The base station 910 may perform restoration of the PUSCH based on the information included in the PUCCH received from the terminal 920. The base station 910 may restore the PUSCH based on the message included in the UCI received from the terminal 920 through the PUCCH. For example, the base station 910 may identify whether the method according to the present disclosure is applied based on the message indicating whether the method according to the present disclosure is applied or not, which is included in the DCI. When it is not indicated to apply the method according to the present disclosure, the base station 910 may restore the PUSCH according to the conventional scheme. On the other hand, when it is indicated to apply the method according to the present disclosure, the base station 910 may perform the restoration of the PUSCH based on the estimated channel information and the first reference value δ obtained from the UCI.

The base station 910 may determine $S_D$ and $S_J$ based on the channel information and the first reference value δ. Alternatively, the base station 910 may determine $S_D$ and $S_J$ according to the same or similar scheme as described with reference to any one of FIGS. 5 to 8. The base station 910 may classify OFDM symbols received through the PUSCH into symbols received through $S_D$ and symbols received through $S_J$. The base station 910 may not decode the symbols received through the $S_J$ as it determines that they correspond to the jamming signal. On the other hand, the base station 910 may determine that the symbols received through the $S_D$ correspond to the data signal and decode them.

The base station 910 may further perform a demodulation operation on the received OFDM symbols before performing decoding. The base station 910 may perform operations such as CP removal, FFT, or channel estimation through the demodulation operation. The base station 910 may perform classification and selective decoding operations on the demodulated signals.

According to the above-described exemplary embodiments of the present disclosure, a security design based on information on a radio channel between communication nodes may be applied to a wireless communication system. Even when information pre-shared by transmitting and receiving nodes is leaked or eavesdropped, security may be guaranteed. That is, the security of the wireless communication system may be secured without a separate security key pre-sharing procedure. According to the above-described exemplary embodiments of the present disclosure, even when all information to be shared between the transmitting and receiving nodes is leaked or eavesdropped, data security may be guaranteed. According to the above-described exemplary embodiment of the present disclosure, subcarrier allocation may be flexibly applied according to a required data rate of data to be transmitted. Accordingly, they may be applied or applied to communication systems of various embodiments.

The above-described exemplary embodiments of the present disclosure have the advantage that they may be implemented without significantly changing specifications of the existing commercial systems such as 5G NR or wireless LAN. The technical effect of the present disclosure may be achieved by using only a small amount of additional message (e.g., 1 to 2 bytes+1 bit) in a part of reserved bits. In addition, even when the additional message is leaked or eavesdropped, the effect may be not reduced. In addition, even when the eavesdropper resolves a channel code of the data, there is an advantage that data bits cannot be decoded by the eavesdropper. Accordingly, the security and marketability of the communication system can be improved.

The exemplary embodiments of the present disclosure may be implemented as program instructions executable by a variety of computers and recorded on a computer readable medium. The computer readable medium may include a program instruction, a data file, a data structure, or a combination thereof. The program instructions recorded on the computer readable medium may be designed and configured specifically for the present disclosure or can be publicly known and available to those who are skilled in the field of computer software.

Examples of the computer readable medium may include a hardware device such as ROM, RAM, and flash memory, which are specifically configured to store and execute the program instructions. Examples of the program instructions include machine codes made by, for example, a compiler, as well as high-level language codes executable by a computer, using an interpreter. The above exemplary hardware device can be configured to operate as at least one software module in order to perform the embodiments of the present disclosure, and vice versa.

While the exemplary embodiments of the present disclosure and their advantages have been described in detail, it should be understood that various changes, substitutions and alterations may be made herein without departing from the scope of the present disclosure.

What is claimed is:

1. A method for transmitting a security signal, performed by a first communication node in a communication system, the method comprising:

estimating a radio channel between the first communication node and a second communication node;

classifying all subcarriers constituting the radio channel into a data subcarrier group and a jamming subcarrier group having different phase ranges, based on a first reference subcarrier selected based on channel information of the estimated radio channel and a first reference value;

generating at least one data symbol by allocating the data signal to subcarriers of the data subcarrier group;

generating at least one jamming symbol by allocating the jamming signal to subcarriers of the jamming subcarrier group;

generating a first control symbol to which a first control signal is mapped, the first control signal including the first reference value; and transmitting the at least one data symbol, the at least one jamming symbol, and the first control symbol to the second communication node, wherein the first reference value is used to classify the all subcarriers into the data subcarrier group and the jamming subcarrier group having the phase different phase ranges at the second communication node.

2. The method according to claim 1, wherein the classifying of all subcarriers comprises:

selecting the first reference subcarrier from among all the subcarriers based on the channel information;

calculating a phase difference value between a phase of the first reference subcarrier and a phase of each of remaining subcarriers; and determining the data subcarrier group and the jamming subcarrier group based on the calculated difference value.

3. The method according to claim 2, wherein subcarriers having a calculated phase difference value equal to or less than the first reference value are determined as the data subcarrier group, and subcarriers having a calculated phase difference value greater than the first reference value are determined as the jamming subcarrier group.

4. The method according to claim 2, wherein the selecting of the first reference subcarrier comprises:

comparing signal magnitudes of all the subcarriers; and selecting a subcarrier having a largest signal magnitude among all the subcarriers as the first reference subcarrier.

5. The method according to claim 1, wherein the first reference value is set based on a data rate required for communication between the first and second communication nodes.

6. A method for receiving a security signal, performed by a first communication node in a communication system, the method comprising:

estimating a radio channel between the first communication node and a second communication node;

receiving a first control symbol including a first reference value from the second communication node;

receiving a plurality of symbols from the second communication node through the radio channel;

obtaining the first reference value from the first control symbol;

classifying all subcarriers constituting the radio channel into a data subcarrier group and a jamming subcarrier group having different phase ranges based on the first reference value and a first reference subcarrier selected based on channel information of the radio channel; and obtaining the data signal by decoding symbols received through the data subcarrier group among the plurality of symbols.

7. The method according to claim 6, wherein the classifying of all subcarriers comprises:

selecting a first reference subcarrier from among all the subcarriers based on the channel information;

calculating a phase difference value between a phase of the first reference subcarrier and a phase of each of remaining subcarriers; and determining the data subcarrier group and the jamming subcarrier group based on the calculated phase difference value.

8. The method according to claim 7, wherein subcarriers having a calculated phase difference value equal to or less than the first reference value are determined as the data subcarrier group, and subcarriers having a calculated phase difference value greater than the first reference value are determined as the jamming subcarrier group.

9. The method according to claim 7, wherein the selecting of the first reference subcarrier comprises:

comparing signal magnitudes of all the subcarriers; and selecting a subcarrier having a largest signal magnitude among all the subcarriers as the first reference subcarrier.

10. A first communication node in a communication system, the first communication node comprising:

a processor;

a memory electronically communicating with the processor; and instructions stored in the memory, wherein when executed by the processor, the instructions cause the first communication node to:

estimate a radio channel between the first communication node and a second communication node;

classify all subcarriers constituting the radio channel into a data subcarrier group and a jamming subcarrier group having different phase ranges, based on a first reference subcarrier selected based on channel information of the estimated radio channel and a first reference value;

generate at least one data symbol by allocating the data signal to subcarriers of the data subcarrier group;

generate at least one jamming symbol by allocating the jamming signal to subcarriers of the jamming subcarrier group;

generate a first control symbol to which a first control signal is mapped, the first control signal including the first reference value; and transmit the at least one data symbol, the at least one jamming symbol, and the first control symbol to the second communication node, wherein the first reference value is used to classify the all subcarriers into the data subcarrier group and the jamming subcarrier group having the different phase ranges at the second communication node.

11. The first communication node according to claim 10, wherein the instructions further cause the first communication node to:

select the first reference subcarrier from among all the subcarriers based on the channel information;

calculate a phase difference value between a phase of the first reference subcarrier and a phase of each of remaining subcarriers; and determine the data subcarrier group and the jamming subcarrier group based on the calculated phase difference value.

12. The first communication node according to claim 11, wherein subcarriers having a calculated phase difference value equal to or less than the first reference value are determined as the data subcarrier group, and subcarriers having a calculated phase difference value greater than the first reference value are determined as the jamming subcarrier group.

13. The first communication node according to claim 11, wherein the instructions further cause the first communication node to:

compare signal magnitudes of all the subcarriers; and select a subcarrier having a largest signal magnitude among all the subcarriers as the first reference subcarrier.

14. The first communication node according to claim 10, wherein the first reference value is set based on a data rate required for communication between the first and second communication nodes.

* * * * *